US008550855B2

(12) United States Patent
Zhang et al.

(10) Patent No.: US 8,550,855 B2
(45) Date of Patent: Oct. 8, 2013

(54) ELECTRICAL CONNECTOR

(75) Inventors: Shuqiang Zhang, Shanghai (CN); Clarence Leon Yu, Shanghai (CN); Doron Lapidot, Tokyo (JP); Jinlong Gong, Shanghai (CN); Suxiang Xu, Shanghai (CN)

(73) Assignees: Tyco Electronics (Shanghai) Co. Ltd., Shanghai (CN); Tyco Electronics Corporation, Berwyn, PA (US); Tyco Electronics Japan G.K., Kanagawa-Ken (JP)

( * ) Notice: Subject to any disclaimer, the term of this patent is extended or adjusted under 35 U.S.C. 154(b) by 190 days.

(21) Appl. No.: 13/248,327

(22) Filed: Sep. 29, 2011

(65) Prior Publication Data

US 2012/0083161 A1 Apr. 5, 2012

(30) Foreign Application Priority Data

Sep. 29, 2010 (CN) ..... 2010 1 0503000

(51) Int. Cl.
*H01R 24/00* (2011.01)

(52) U.S. Cl.
USPC ..... 439/636; 439/637

(58) Field of Classification Search
USPC ..... 439/636, 637, 607.5–607.6, 607.14
See application file for complete search history.

(56) References Cited

U.S. PATENT DOCUMENTS

| | | | | |
|---|---|---|---|---|
| 7,229,319 | B2 * | 6/2007 | Dahms et al. | 439/607.06 |
| 7,410,392 | B2 * | 8/2008 | Szczesny et al. | 439/607.05 |
| 7,604,510 | B2 * | 10/2009 | Akama et al. | 439/637 |
| 7,731,541 | B1 * | 6/2010 | Lee et al. | 439/660 |
| 7,824,224 | B2 * | 11/2010 | Su et al. | 439/629 |
| 8,231,411 | B1 * | 7/2012 | Westman et al. | 439/607.05 |
| 8,282,421 | B2 * | 10/2012 | Lee et al. | 439/629 |

* cited by examiner

*Primary Examiner* — Xuong Chung Trans
(74) *Attorney, Agent, or Firm* — Barley Snyder

(57) ABSTRACT

An electrical connector for connecting with an electrical card comprises a plurality of signal terminal modules and at least one ground terminal. Each of the plurality of signal terminal modules having a pair of signal terminal and an insulation body. Each of the pair of signal terminals include a first contact portion, a first securing portion, and a first connection portion positioned between the first contact portion and the first securing portion. The insulation body is overmolded to each first connection portion of the pair of signal terminals. The ground terminal includes a pair of second contact portions, a second securing portion, and a second connection portion positioned between the pair of second contact portions and the second securing portion. The insulation body includes openings positioned to correspond to each of the pair of signal terminals, with a portion of each of the pair of signal terminals is exposed.

10 Claims, 5 Drawing Sheets

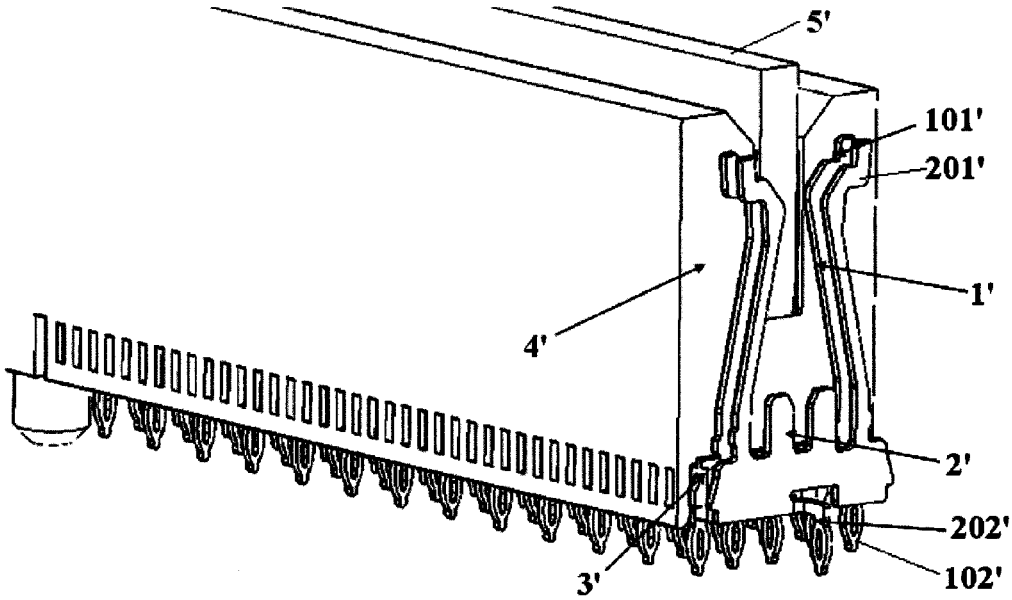
Fig. 1 PRIOR ART
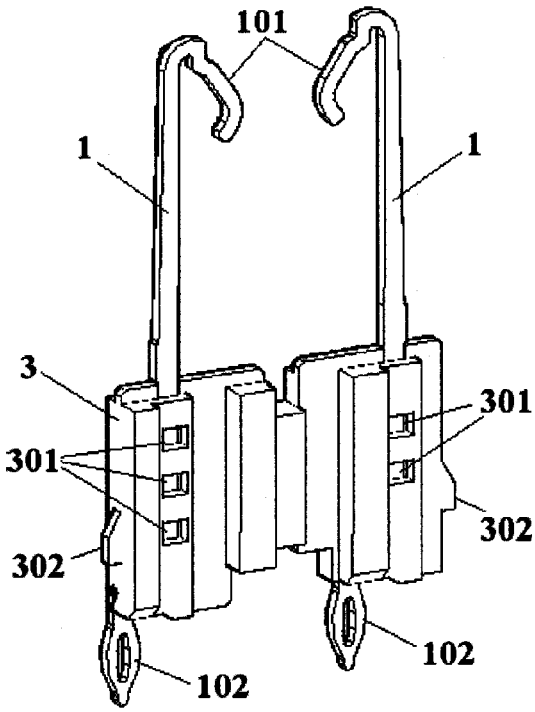
Fig. 2
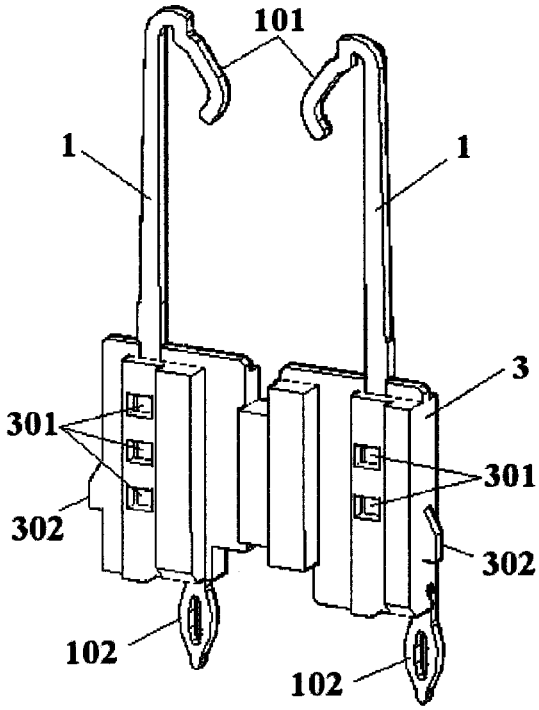
Fig. 3

ELECTRICAL CONNECTOR

CROSS-REFERENCE TO RELATED APPLICATION

This application claims the benefit under 35 U.S.C. §119 (a)-(d) of Chinese Patent Application No. 201010503000.5 filed on Sep. 29, 2010.

FIELD OF THE INVENTION

The present invention relates to an electrical connector, and more particularly, to an electrical connector being capable of transmitting high-speed signals.

BACKGROUND

FIG. 1 shows a known electrical connector having pairs of signal terminals 1' and a ground terminal 2'. Each of the signal terminals 1' includes a first contact portion 101', first securing portion 102' (shaped like an eye shown in FIG. 1), and a first connection portion between the first contact portion 101' and the first securing portion 102'. The ground terminal 2' has a pair of second contact portions 201", a second securing portion 202' (shaped like an eye shown in FIG. 1), and a second connection portion between the second contact portions 201' and the second securing portion 202'.

Referring to FIG. 1, each pair of first contact portions 101' extends upward and is bent apart from each other in the shape of an opened arm. Thereby, there is an relative long residual end after a contact point between the first contact portion 101' and an electrical card 5', which causes lower impedance about the contact point of the signal terminal and deteriorates the quality of the signal transmission.

As shown in FIG. 1, the second securing portion 202' of the ground terminal 2' offsets from a symmetrical center line of the ground terminal 2' and does not extend out along the center line. Furthermore, the width direction of the second securing portion 202' of the ground terminal 2' is perpendicular to that of the first securing portion 102' of the signal terminal V. That is, the ground terminal 2' has an asymmetrical structure, which causes the return circuit of signal imbalanced and generates interference between the signal and ground terminals 1', 2'.

Furthermore, each pair of signal terminals 1' is embedded in a plastic body 3' except for the first securing portions 102' such that the design causes lower impedance of the portion, which is embedded in the plastic body 3', of the signal terminal 1' and deteriorates the quality of the signal transmission; generating signal delay.

SUMMARY

The present invention has been made to overcome or alleviate at least one aspect of the above mentioned disadvantages.

Accordingly, it would be advantageous to provide an electrical connector which can effectively increase the quality of the signal transmission.

An electrical connector for connecting with an electrical card comprises a plurality of signal terminal modules and at least one ground terminal. Each of the plurality of signal terminal modules having a pair of signal terminal and an insulation body. Each of the pair of signal terminals include a first contact portion, a first securing portion, and a first connection portion positioned between the first contact portion and the first securing portion. The insulation body is overmolded to each first connection portion of the pair of signal terminals. The ground terminal includes a pair of second contact portions, a second securing portion, and a second connection portion positioned between the pair of second contact portions and the second securing portion. The insulation body includes openings positioned such that the openings to correspond to each of the pair of signal terminals, with a portion of each of the pair of signal terminals is exposed to ambient air.

BRIEF DESCRIPTION OF THE DRAWINGS

The above and other features of the present invention will become more apparent by describing in detail embodiments thereof with reference to the accompanying drawings, in which:

FIG. 1 is a perspective view of a known electrical connector;

FIG. 2 is a front view of a signal terminal module according to the invention;

FIG. 3 is a back view of the signal terminal module shown in FIG. 2;

DETAILED DESCRIPTION OF THE EMBODIMENT(S)

Figure 4:
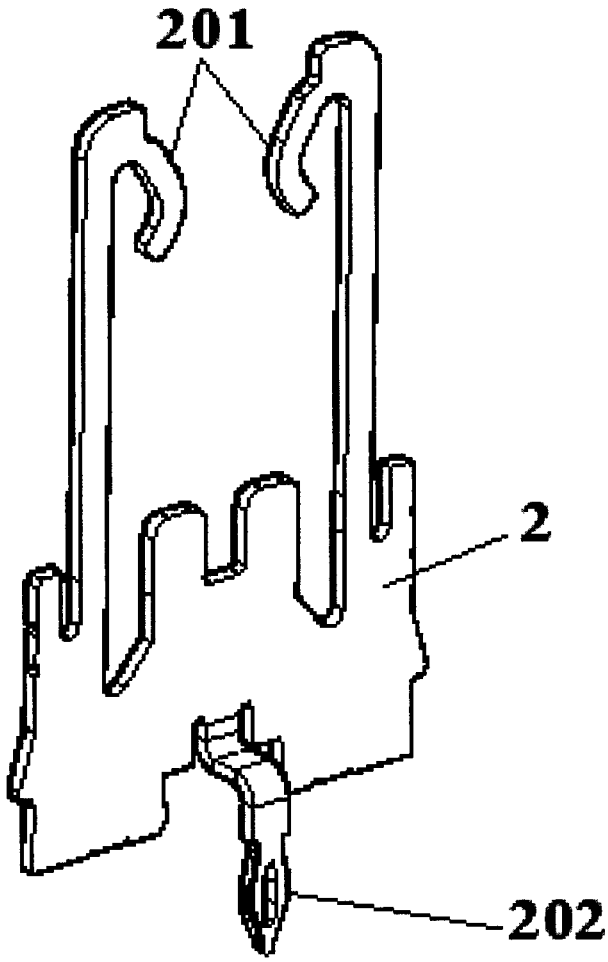
FIG. 4 is a perspective view of a ground terminal according to the invention.

The embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

As shown in FIG. 2, each of the signal terminal modules according to the includes a pair of signal terminals 1, 1 positioned opposite to each other, and an insulation body 3 of plastic molded onto the pair of signal terminals 1, 1 through an overmolding process.

Referring to FIG. 2, each of the pair of signal terminals 1, 1 includes a first contact portion 101, a first securing portion 102 (shaped like an eye in FIG. 2), and a first connection portion positioned between the first contact portion 101 and the first securing portion 102. The insulation body 3 is molded on the first connection portions of the pair of signal terminals 1, 1 to form an integrated signal terminal module.

In the embodiment shown in FIG. 2, the first securing portion 102 is shaped like an eye. But the present invention is not limited to this, the securing portion 102 may be shaped like a foot or a pin adapted for surface mounted technology (SMT).

As shown in FIG. 2, during the overmolding of the insulation body 3, openings 301 are formed in a front surface of the insulation plastic body 3. These openings 301 are positioned corresponding to the signal terminals 1, 1 such that portions of the signal terminals 1, 1 corresponding to the openings 301 along the front surface are exposed to ambient air, instead of being sealed in the insulation plastic body 3.

In the embodiment shown in FIG. 2, along the front surface of the insulation plastic body 3, three openings 301 are positioned to correspond to one of the pair of signal terminals 1, 1, while two openings 301 are positioned to correspond to the other one of the pair of signal terminals 1, 1. Please note that the present invention is not limited to the shown embodiment. Rather, the number and size of the openings 301 along the front surface may be modified as necessary.

As shown in FIG. 3, openings 301 are also formed along the back surface of the insulation plastic body 3. The openings 301 positioned on the back surface are located at positions corresponding with the signal terminals 1, 1 so that portions of the signal terminals 1, 1 corresponding to the openings 301 along the back surface are exposed to the ambient air, instead of being sealed in the insulation plastic body 3.

In the embodiment shown in FIG. 3, along the back surface of the insulation plastic body 3, two openings 301 are positioned to correspond to the one of the pair of signal terminals 1, 1 while three other openings 301 are positioned to correspond to the other one of the pair of signal terminals 1, 1 are formed. Please be note that the present invention is not limited to this design, and the number and size of the openings 301 positioned along the back surface may be modified according to actual requirements.

In an embodiment shown in FIGS. 2 and 3, the openings 301 along the back surface of the insulation body 3 of a front one of two adjacent signal terminal modules are not aligned with the openings 301 positioned along the front surface of the insulation body 3 of the rear one of the two adjacent signal terminal modules, that is, the openings 301 along the back surface of the insulation body 3 of the front one of two adjacent signal terminal modules are staggered with the openings 301 along the front surface of the insulation body 3 of the rear one of the two adjacent signal terminal modules. Accordingly, when two adjacent signal terminal modules are assembled together, the openings 301 along the back surface of the insulation body 3 of the front one of two adjacent signal terminal modules do not communicated with the openings 301 along the front surface of the insulation body 3 of the rear one of the two adjacent signal terminal modules. Accordingly, the design avoids interference between the signal terminals of the front signal terminal module and those of the rear signal terminal module.

As shown in FIGS. 2 and 3, because openings 301 are formed along the front and back surfaces of the insulation plastic body 3, the impedance of the portion of the signal terminal 1 which is embedded in the insulation plastic body 3 can be increased so that the signal reflex due to the discontinuity of the impedance can be reduced. Additionally, the transmission speed of the signal terminal in the region about the openings can be increased, and the signal delay can be reduced.

The impedance Z of signal terminal 1 in the insulation plastic body 3 can be calculated by the following formula (1):

$$Z=(L/C)^{1/2}$$

Wherein, L is the inductance of the signal terminal; C is the capacitance of the signal terminal.

The openings 301 formed along the front and back surfaces of the insulation plastic body 3 can reduce the capacitance C of the signal terminal, so the impedance Z of signal terminal 1 can be increased.

The signal delay (Propagation Delay) of the signal terminal 1 in the insulation plastic body 3 can be calculated by the following formula (2):

$$\text{Propagation Delay}=L*\text{sqrt}(\in)/C \quad (2)$$

Wherein, L is the length of the signal terminal; $\in$ is the dielectric constant of the material about the signal terminal; and C is the velocity of the light.

The openings 301 formed along the front and back surfaces of the insulation plastic body 3 can effectively reduce the dielectric constant E, and the signal delay can be reduced.

As shown in FIG. 4, the ground terminal 2 includes a pair of second contact portions 201, a second securing portion 202 (shaped like an eye in FIG. 4) and a second connection portion positioned between the second contact portions 201 and the second securing portion 202. But the present invention is not limited to this, the second securing portion 202 may be shaped like a foot or a pin adapted for surface mounted technology (SMT), or other design.

Referring to FIGS. 2 and 3 again, the first contact portion 101 of the signal terminal 1 in the embodiment shown has a hook shape. The contact point between the first contact portion 101 and the electrical card 5 (shown in FIG. 7) is located at a vertex of an arc section adjacent to a free end of the first contact portion 101 so that the residual end of the first contact portion 101 after the contact point is much shorter than the contact portion 101' of the known electrical connector shown in FIG. 1.

Referring to FIG. 4 again, the second contact portion 201 of the ground terminal 2 also has a hooked shape. The contact point between the second contact portion 201 and the electrical card 5 (shown in FIG. 7) is located at a vertex of an arc section adjacent to a free end of the second contact portion 201 so that the residual end of the second contact portion 201 after the contact point is much shorter than the contact portion 201' of the known electrical connector shown in FIG. 1.

Compared with the known electrical connector shown in FIG. 1, the residual end of the present invention is shortened; thereby the capacitance C of the signal terminal is reduced. According to the above formula (I), the impedance Z of signal terminal 1 can be increased. Accordingly, the signal reflex due to the discontinuity of the impedance can be reduced.

As shown in FIGS. 2 and 3, the impedance of the signal terminal 1 is affected by the electrical card 5, that is, if the signal terminal has a constant width, the impedance of the signal terminal 1 is gradually reduced from the first contact portion 101 of the signal terminal 1 adjacent to the electrical card 5 to the first securing portion 102 apart from the electrical card 5. Accordingly, in the shown embodiment, the first signal terminal 1 has a width gradually reduced from the first securing portion 102 to the first contact portion 101 to ensure that the impedance of the signal terminal 1 keeps uniform from the first contact portion 101 to the first securing portion 102.

As shown in FIG. 4, the ground terminal 2 in the embodiment shown has a symmetrical structure. The pair of second contact portions 201 are symmetrically located along both sides of a center line of the ground terminal 2. The second securing portion 202 is located at the center line of the ground terminal 2 and extends along the center line of the ground terminal 2.

Compared with the asymmetrical ground terminal 2' of the known electrical connector shown in FIG. 1, the ground terminal 2 of the present invention has a completely symmetrical structure, it can provide a balanced circuit for the signal terminals 1 and can prohibit the signal noise among the signal terminals.

Figure 5:
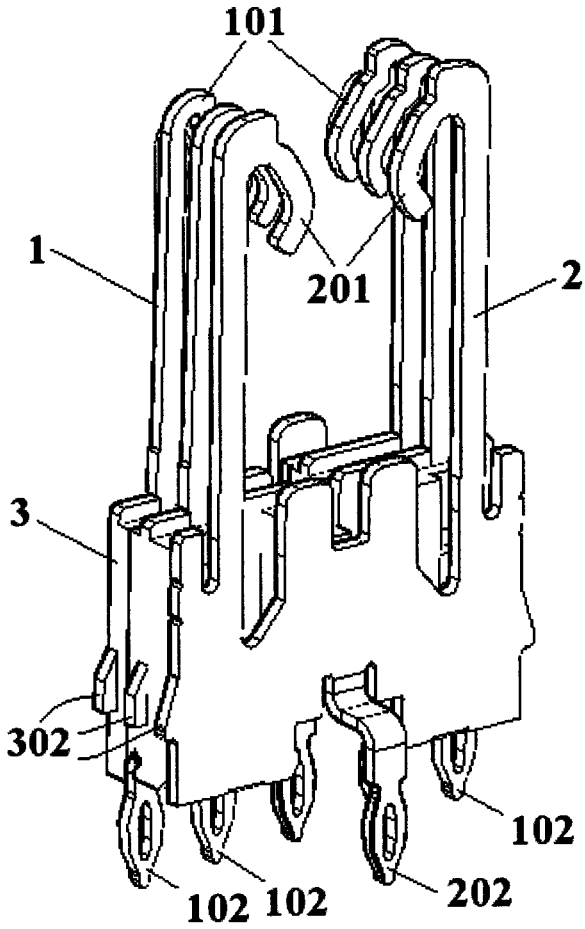
FIG. 5 is a perspective view of two signal terminal modules and one ground terminal arranged in a front to back sequence.
Figure 6:
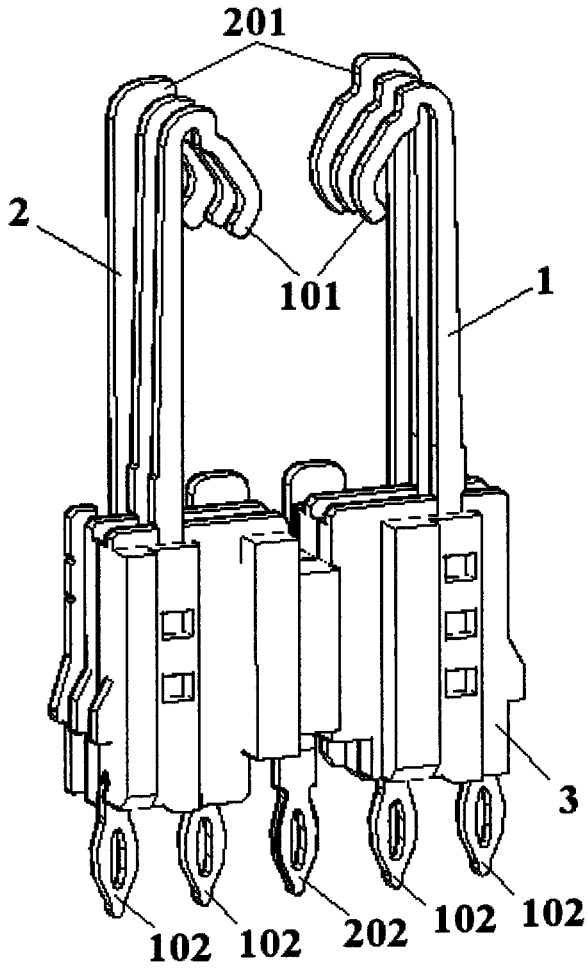
FIG. 6 is a back view of FIG. 5.

As shown in FIGS. 5 and 6, the width direction of the second securing portion 202 of the ground terminal 2 is parallel to that of the first securing portion 102 of the signal terminal 1.

Figure 7:
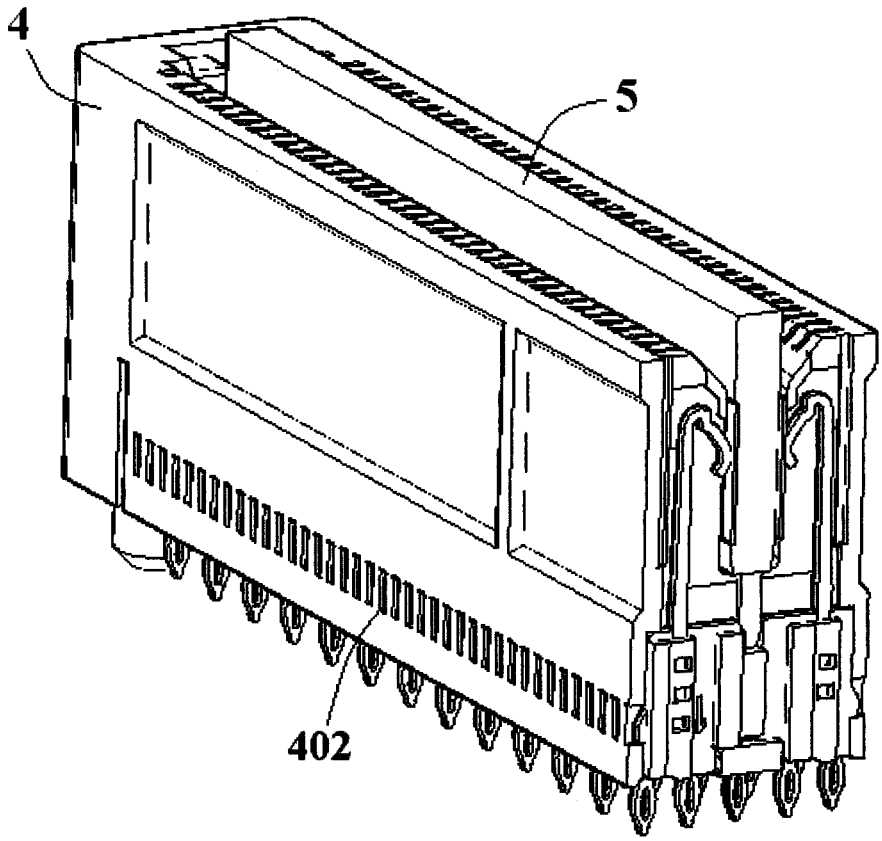
FIG. 7 is an perspective view of an electrical connector according to the invention.

As shown in FIG. 7, the electrical connector according to the invention further includes an insulation housing 4.

As shown in FIGS. 5 and 6, protrusions 302 are formed on the signal terminal modules and the ground terminal and are fitted into notches 402 of the insulation housing 4 to stably fix the signal terminal modules and the ground terminal in the insulation housing 4.

As shown in FIG. 7, when the signal terminal modules and the ground terminal are assembled in the housing 4, the securing portions 102, 202 of the signal and ground terminals 1, 2 extend out of the bottom of the insulation housing 4, and the other portions of the signal and ground terminals 1, 2 are contained in the insulation housing 4. The electrical card 5 is inserted into a slot formed in the top of the insulation housing 4 and makes electrically contact with the contact portions 101, 201 of the signal and ground terminals 1, 2.

Although several embodiments have been shown and described, it would be appreciated by those skilled in the art that various changes or modifications may be made in these embodiments without departing from the principles and spirit of the disclosure, the scope of which is defined in the claims and their equivalents. It should be noted that the term "comprising" does not exclude other elements or steps and the "a" or "an" does not exclude a plurality. It should also be noted that reference signs in the claims shall not be construed as limiting the scope of the claims.

What is claimed is:

1. An electrical connector for connecting with an electrical card, comprising:

a plurality of signal terminal modules, each of the plurality of signal terminal modules comprising:

a pair of signal terminals, each of the pair of signal terminals having a first contact portion, a first securing portion, and a first connection portion positioned between the first contact portion and the first securing portion; and an insulation body overmolded to each first connection portion of the pair of signal terminals; and a ground terminal having a pair of second contact portions, a second securing portion, and a second connection portion positioned between the pair of second contact portions and the second securing portion;

wherein the insulation body includes openings formed along a front surface and a back surface of the insulation body and corresponding to each of the pair of signal terminals so that a portion of each of the pair of signal terminals is exposed to ambient air;

wherein the plurality of signal terminal modules are arranged in a front to back arrangement and the openings along the back surface of the insulation body of a front one of two adjacent signal terminal modules are staggered with the openings positioned along the front surface of the insulation body of a rear one of the two signal terminal modules positioned adjacent to each other.

2. The electrical connector according to claim 1, wherein each first contact portion is hook shaped.

3. The electrical connector according to claim 2, wherein a contact point of each first contact portion is positioned at a vertex of an arc section adjacent to a free end of the first contact portion.

4. The electrical connector according to claim 1, wherein a width of each signal terminal gradually narrows from the first securing portion to the first contact portion.

5. The electrical connector according to claim 1, wherein the ground terminal is a symmetrical structure.

6. The electrical connector according to claim 5, wherein the pair of second contact portions are positioned symmetrically along both sides of a center line splitting the ground terminal.

7. The electrical connector according to claim 6, wherein the second securing portion is positioned along the center line splitting the ground terminal.

8. The electrical connector according to claim 7, wherein the second securing portion is positioned parallel with each first securing portion of the pair of signal terminals.

9. The electrical connector according to claim 8, further comprises an insulation housing.

10. The electrical connector according to claim 9, wherein each first securing portion and the second securing portion extend through a bottom surface of the insulation housing.

* * * * *